US007407038B2

(12) United States Patent
Warner et al.

(10) Patent No.: US 7,407,038 B2
(45) Date of Patent: Aug. 5, 2008

(54) LIFTING FRAMEWORK FOR AN INDUSTRIAL TRUCK

(75) Inventors: Barry Michael Warner, Hants (GB); Paul John Eckersley, Hants (GB); Keith Francis Messer, Hants (GB)

(73) Assignee: Linde Material Handling GmbH, Aschaffenburg (DE)

( * ) Notice: Subject to any disclaimer, the term of this patent is extended or adjusted under 35 U.S.C. 154(b) by 63 days.

(21) Appl. No.: 10/984,692

(22) Filed: Nov. 9, 2004

(65) Prior Publication Data

US 2005/0133311 A1 Jun. 23, 2005

(30) Foreign Application Priority Data

Nov. 10, 2003 (GB) ..... 0326175.7

(51) Int. Cl.
*B66F 9/06* (2006.01)

(52) U.S. Cl. ..... 187/226; 187/234; 187/238; 414/631; 414/785; 182/2.11

(58) Field of Classification Search ..... 187/222, 187/226, 414, 269, 272, 274; 414/619, 630, 414/631, 785; 182/2.1, 2.11; *B66B 9/04, B66B 9/06, 9/20; F15B 1/02, 15/14; B66F 9/20, B66F 9/06*

See application file for complete search history.

(56) References Cited

U.S. PATENT DOCUMENTS

| | | | | | |
|---|---|---|---|---|---|
| 2,670,811 | A | * | 3/1954 | Shaffer | 187/229 |
| 3,172,339 | A | * | 3/1965 | Quayle | 92/51 |
| 3,208,556 | A | * | 9/1965 | Shaffer | 187/226 |
| 3,252,545 | A | * | 5/1966 | Quayle | 187/229 |
| 3,394,778 | A | * | 7/1968 | Brinton | 187/227 |
| 3,534,664 | A | * | 10/1970 | Ulinski | 92/146 |
| 3,709,393 | A | * | 1/1973 | McGehee | 414/635 |
| 4,008,648 | A | * | 2/1977 | Farmer et al. | 91/168 |
| 4,261,438 | A | * | 4/1981 | Olson | 187/227 |
| 4,392,554 | A | * | 7/1983 | Russey | 187/226 |

FOREIGN PATENT DOCUMENTS

| | | | |
|---|---|---|---|
| DE | 3529601 | A | 3/1987 |
| GB | 1 406 561 | A | 9/1975 |
| GB | 1 520 990 | A | 8/1978 |
| GB | 2 016 410 | A | 9/1979 |
| GB | 2 171 666 | A | 9/1986 |
| SU | 436796 | A | 7/1974 |

* cited by examiner

*Primary Examiner*—Peter M. Cuomo
*Assistant Examiner*—Stefan Kruer
(74) *Attorney, Agent, or Firm*—The Webb Law Firm

(57) ABSTRACT

A lifting framework for an industrial truck has an extendible mast guided on a guide mast by rollers. Means are provided for bracing the extendible mast with the guide mast so as to prevent the extendible mast from inclining in the lateral direction of the lifting framework relative to the guide mast. The bracing means are configured such that, when the extendible mast is located in the top end position, a vertical movement of the extendible mast relative to the guide mast is prevented in the region of each of the two columns. A hydraulic lifting cylinder and a stop for the top end position of the extendible mast are arranged here in the region of each column.

5 Claims, 5 Drawing Sheets

LIFTING FRAMEWORK FOR AN INDUSTRIAL TRUCK

CROSS-REFERENCE TO RELATED APPLICATION

This application claims priority to British Application No. 0326175.7 filed Nov. 10, 2003, which is herein incorporated by reference in its entirety.

BACKGROUND OF THE INVENTION

1. Field of the Invention

The invention relates to a lifting framework for an industrial truck. The lifting framework has a guide mast and at least one extendible mast. The extendible mast is guided on the guide mast by means of rollers such that it can be moved in the vertical direction between a bottom end position and a top end position.

2. Technical Considerations

Lifting frameworks of the type mentioned above are used in industrial trucks, for example, counterbalance fork trucks or fork-lift reach trucks. A load-bearing means is guided on the lifting framework such that it can be moved in the vertical direction for bearing and raising loads. In most types of industrial trucks, the load-bearing means is located at the front with respect to the main direction of travel. The lateral direction of the lifting framework thus corresponds, by definition, to the lateral direction of the industrial truck. The lifting framework is usually extended telescopically, with at least one extendible mast being guided in a vertically movable manner on a non-raisable vertical mast. The extendible mast is guided on the vertical mast by means of rollers, in each case one pair of coaxial rollers usually being arranged at the top end of the vertical mast and at the bottom end of the extendible mast. The rollers here have a horizontal axis of rotation which is oriented in the lateral direction of the lifting framework and thus of the industrial truck.

The extendible mast is guided laterally on the vertical mast by the lateral surfaces of the above-mentioned rollers. Moments which act on the extendible mast about a longitudinal axis of the industrial truck, and would cause the extendible mast to tilt laterally, are thus supported by the lateral surfaces of the vertically spaced-apart rollers on the mast profiles. It is nevertheless possible, during operation of the industrial truck, for example in the case of asymmetric load action, for the lateral play of the rollers in the mast profiles to give rise to the extendible mast inclining laterally to a slight extent relative to the vertical mast. The greatest amount of inclination on the part of the extendible mast is possible when the extendible mast is located in the region of its top end position, since the vertical spacing between the pair of rollers fastened on the vertical mast and the pair of rollers fastened on the extendible mast is then minimal. The lateral inclination of the extendible mast relative to the vertical mast, this inclination being possible on account of the lateral play of the rollers, is further increased in the case of wide lifting frameworks in which the columns are spaced far apart in the transverse direction of the industrial truck.

An object of the present invention is thus to provide a lifting framework in which the capacity of the extendible mast to incline laterally relative to the vertical mast is at least partially reduced.

SUMMARY OF THE INVENTION

The invention provides means for bracing the extendible mast with the guide mast. This bracing means taking effect, at least when the extendible mast is located in the top end position, so as to prevent or reduce the extendible mast from inclining in the lateral direction of the lifting framework relative to the guide mast. The means for bracing the extendible mast with the guide mast prevents, in particular, lateral inclination of the extendible mast. The moments which act on the extendible mast about a longitudinal direction of the industrial truck are supported here by the means for bracing the extendible mast with the guide mast rather than by the rollers. The play and the elasticity of the rollers in this state then do not have any effect on the lateral stability of the extendible mast. The extendible mast is preferably braced in a position in which it is coaxial with the guide mast. This automatically corrects any lateral inclination of the extendible mast which may be present before the means for bracing the extendible mast with the guide mast takes effect.

In a first embodiment, the guide mast is formed by a vertical mast and a first extendible mast is guided on the vertical mast. A means is provided for bracing the first extendible mast with the vertical mast. The first extendible mast may thus be braced with the vertical mast.

In a development of the arrangement according to the invention, the guide mast is formed by a first extendible mast and a second extendible mast is guided on the first extendible mast. A means is provided for bracing the second extendible mast with the first extendible mast. The second extendible mast may thus be braced with the first extendible mast. It is additionally possible, as has been described above, for the first extendible mast to be braced with the vertical mast. Lateral inclination of all the extendible masts relative to the vertical mast can thus be reliably prevented.

The guide mast and the at least one extendible mast generally have two columns which are spaced apart in the lateral direction of the lifting framework. Each of the columns has a specifically shaped steel profile configured for absorbing the moments and forces which occur and, at the same time, have guide tracks for the above-described rollers.

According to a first possible configuration, the means for bracing the extendible mast with the guide mast is configured such that, when the extendible mast is located in the top end position, a vertical movement of the extendible mast relative to the guide mast is prevented in the region of each of the two columns. The extendible mast is thus braced with the guide mast by a force which acts in the vertical direction. In the region of each column, that is to say at two locations which are spaced apart from one another in the lateral direction of the lifting framework, the extendible mast is pressed against a stop on the guide mast. This prevents an inclining movement of the extendible mast in the lateral direction since, for this purpose, the extendible mast would have to lift off from the stop at least one location, but the bracing precludes this possibility.

A hydraulic lifting cylinder and a stop for the top end position of the extendible mast can be expediently arranged in the region of each column. The hydraulic lifting cylinders can be connected, on the piston side, to the extendible mast and, on the cylinder-tube side, to the guide mast, or vice versa. The lifting cylinders, which produce the force for raising the extendible mast, also apply the force for bracing the extendible mast with the guide mast. For this purpose, one lifting cylinder can be arranged in the region of each column of the lifting framework, the cylinder forcing the extendible mast against the respective stop.

The stop is particularly advantageously part of the hydraulic lifting cylinder. The maximum extendible length of each lifting cylinder is defined by a stop which is integrated in the lifting cylinder. The stop may be formed by a part of the cylinder tube with which the piston comes into contact at the end of the extending movement.

A second possible configuration provides that the means for bracing the extendible mast with the guide mast is configured such that, when the extendible mast is located at least more or less in the top end position, the vertical movements of the two columns of the extendible mast are coupled to one another. This ensures that the columns of the extendible mast are moved synchronously, as a result of which lateral inclination of the extendible mast is reliably prevented.

This is made possible in that, when the extendible mast is located at or near the top end position, the two columns of the extendible mast are coupled to one another by means of a scissor mechanism. The scissor mechanism can have two scissor levers connected by a central joint. The connecting lines between the bottom end points of the scissor levers and the connecting lines between the top end points of the scissor levers can be always parallel. The bottom end points of the scissor levers can be guided in a rail fastened on the guide mast, while the top end points of the scissor levers can be guided in a rail fastened on the extendible mast. The scissor mechanism ensures that the two rails are always parallel to one another and that inclination of the extendible mast relative to the guide mast is thus ruled out.

According to an advantageous development of the invention, the lifting framework has a vertical mast, a first extendible mast guided on the vertical mast, a second extendible mast guided on the first extendible mast, and a lifting-drive device configured such that, in the first instance, the first extendible mast, together with the second extendible mast, is raised relative to the vertical mast and, thereafter, the second extendible mast is raised relative to the first extendible mast. In contrast to the conventional arrangement from the known art, in this case when the lifting framework is extended telescopically, in the first instance the first extendible mast, together with the second extendible mast, is raised along the vertical mast. When the first extendible mast has reached its stop on the vertical mast, the lifting movement of the second extendible mast relative to the first extendible mast begins.

Lateral inclination of the extendible masts can be largely completely avoided if a means is provided for bracing the first extendible mast with the vertical mast and a means is provided for bracing the second extendible mast with the first extendible mast. When the first extendible mast has reached its top end position, it is braced with the vertical mast. During the subsequent extension of the second extendible mast, the vertical orientation of the first extendible mast is thus ensured. When, finally, the second extendible mast has reached its end position, it is braced with the first extendible mast and is thus likewise secured against lateral inclination.

In a more straightforward but likewise expedient configuration, just a means for bracing the first extendible mast with the vertical mast can be provided. It proves to be sufficient in practice to brace the first extendible mast with the vertical mast. This arrangement can be used to ensure that the lower of the two extendible masts, when the lifting framework has been extended, is located vertically and is secured against lateral inclination. This also reduces to an acceptable extent, when the second extendible mast has been fully extended, the maximum lateral offset of the top lifting-framework end.

A particularly straightforward arrangement is achieved if the lifting-drive device has at least one hydraulic telescopic cylinder. A first piston of the telescopic cylinder can be provided for raising the first extendible mast relative to the vertical mast and a second piston of the telescopic cylinder can be provided for raising the second extendible mast relative to the first extendible mast. In the case of this arrangement, the amount of space required by the lifting-drive device is minimized. The above-described order in which the extendible masts extend automatically results from the different effective surface areas of the coaxially arranged pistons of the telescopic cylinder.

The invention is particularly advantageous if the extendible mast is guided on the non-extendible mast by means of rollers, the rollers being arranged such that in the top end position of the extendible mast the ratio of the horizontal spacing between the left and right rollers to the vertical spacing between the top and bottom rollers is greater than two. Relatively wide lifting frameworks have a greater tendency to lateral inclination than narrow lifting frameworks. The means according to the invention for bracing the extendible mast with the guide mast can compensate for this disadvantage of wide-lifting frameworks.

BRIEF DESCRIPTION OF THE DRAWINGS

Further advantages and details of the invention will be explained more specifically with reference to the exemplary embodiments illustrated in the schematic figures, in which.

DESCRIPTION OF THE PREFERRED EMBODIMENTS

Figure 1:
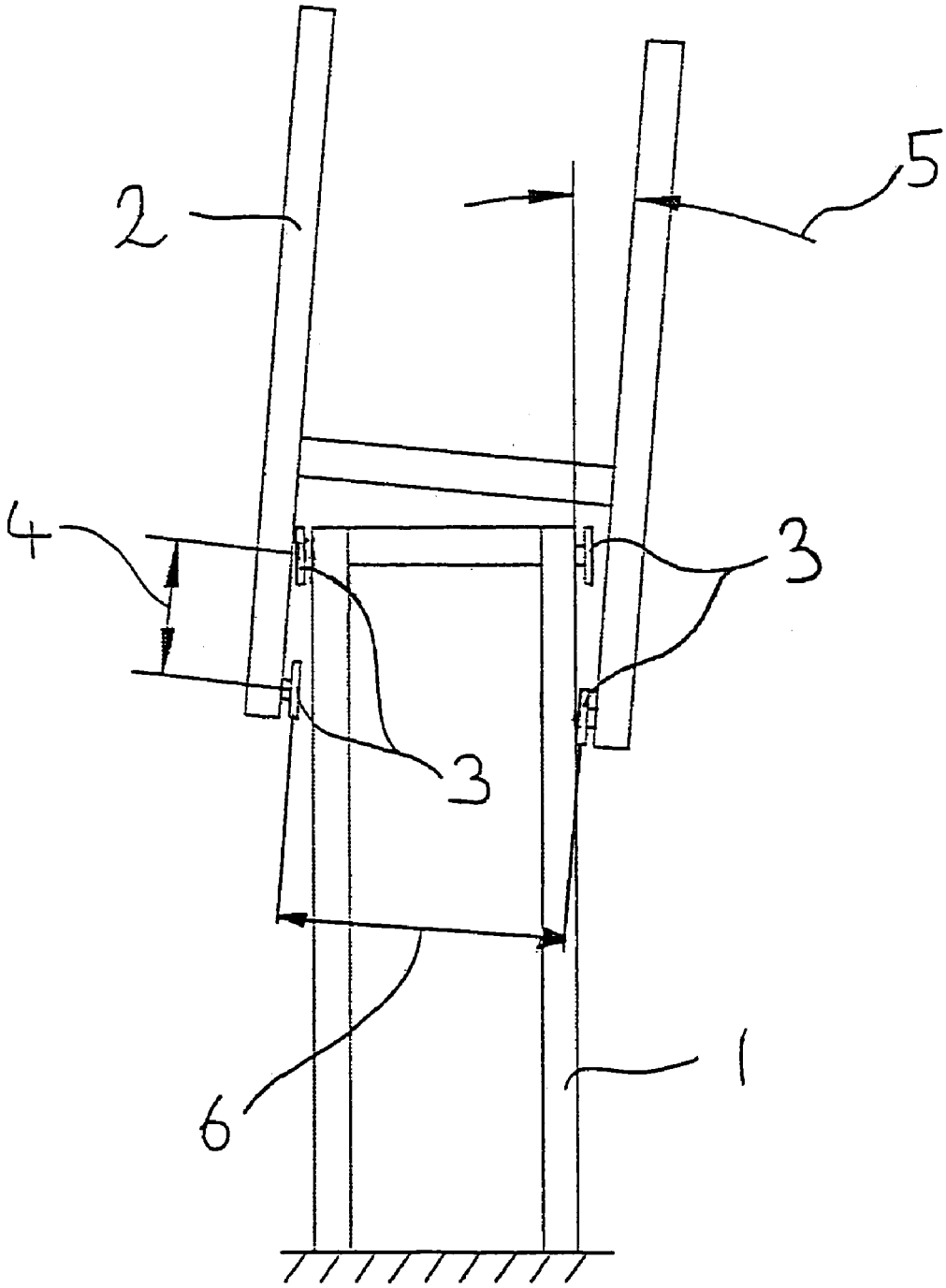
FIG. 1 shows a lifting framework of the generic type.

FIG. 1 shows a lifting framework of the generic type with a non-extendible vertical mast 1 and an extendible mast 2. The extendible mast 2 is guided on the vertical mast 1 by means of rollers 3 such that it can be displaced in the vertical direction, the vertical mast 1 thus forming the guide mast. The bottom two rollers 3 of the total of four rollers are mounted in a rotatable manner on the extendible mast 2, while the top two rollers 3 of the four rollers are mounted at the top end of the vertical mast 1. In the illustrated top end position of the extendible mast 2, when the vertical spacing 4 between the top and bottom rollers 3 is minimal, the extendible mast 2 can be inclined laterally by the angular extent 5 relative to the vertical mast 1. This effect is based on the play of the rollers 3, which is inevitably present in the lateral direction, and becomes more pronounced in the case of wide lifting frameworks (e.g., greater than 900 mm), on account of the wider roller arrangement associated therewith. In particular, this is the case when the ratio of the horizontal spacing 6 between the rollers 3 to the vertical spacing 4 between rollers 3 is greater than two.

Figure 4:
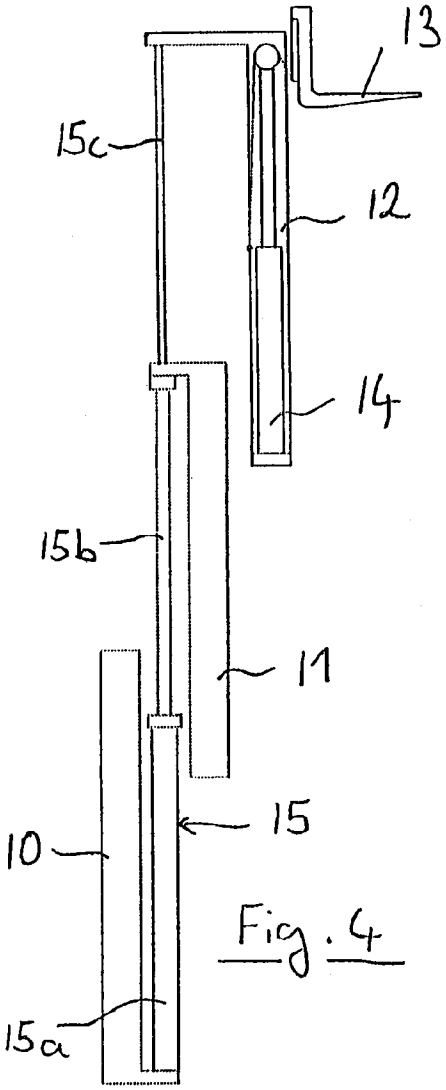
FIGS. 2, 3, and 4 show a lifting framework according to the invention in three different extension positions.
Figure 3:
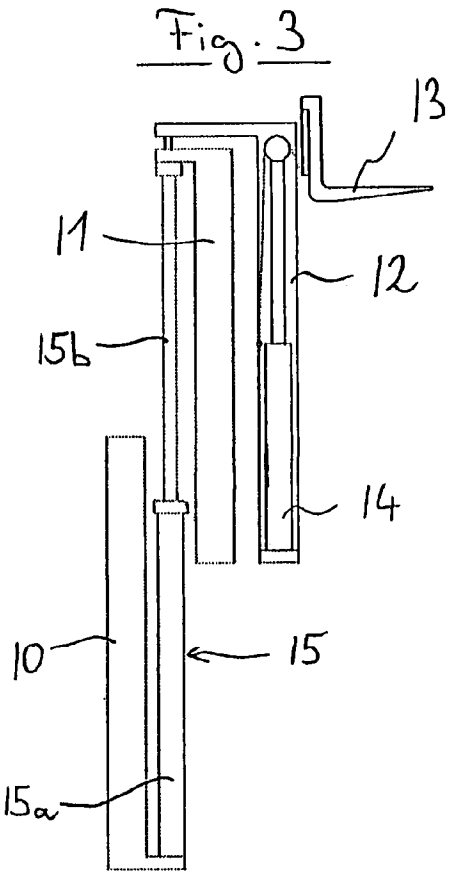
Figure 2:
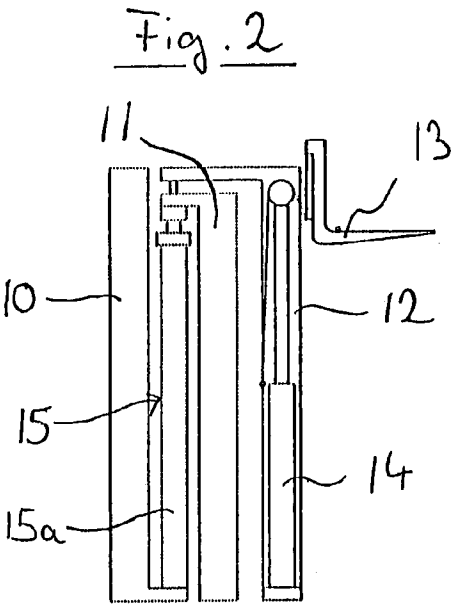

FIGS. 2, 3, and 4 illustrate a lifting framework according to the invention in three different extension positions. The lifting framework is a so-called triplex lifting framework with a vertical mast 10, a first extendible mast 11, and a second extendible mast 12. In this case, the vertical mast 10 constitutes the guide mast for the first extendible mast 11. The first extendible mast 11, in turn, forms the guide mast for the second extendible mast 12. Also illustrated is a load-bearing means 13 configured as a load fork and guided in a displaceable manner on the second extendible mast 12. The force which is necessary for displacing the load-bearing means 13 along the second extendible mast 12 can be produced by means of an initial lifting cylinder 14. The latter can be used to move the load-bearing means 13 between a position in the vicinity of the floor and the position which is illustrated in FIG. 2. A hydraulic lifting cylinder 15 configured as a telescopic cylinder serves for raising the two extendible masts 11, 12. In this case, a cylinder tube 15*a* of the lifting cylinder 15 is connected to the vertical mast 10. A first piston 15*b* of the lifting cylinder 15 is connected to the first extendible mast 11, while a second piston 15*c* of the lifting cylinder 15 is connected to the second extendible mast 12.

The order in which the extendible masts are extended can be as illustrated in FIGS. 2, 3, and 4. When the load-bearing means 13 has reached its stop on the second extendible mast 12, the extending movement of the first extendible mast 11 begins, the second extendible mast 12 and the load-bearing means 13 being raised along therewith. When the first piston 15*b* of the lifting cylinder 15 has reached its stop in the cylinder tube 15*a*, the extending movement of the second piston 15*c* begins. This second piston 15*c* raises the second extendible mast 12 relative to the first extendible mast 11 up to the end position illustrated in FIG. 4.

Figure 7:
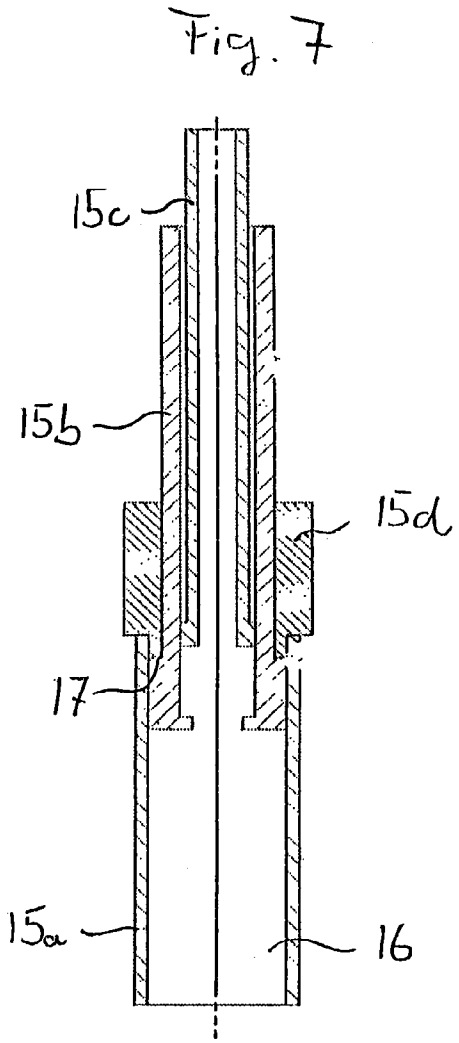
FIGS. 5, 6, and 7 show a hydraulic telescopic cylinder in three different extension positions.
Figure 6:
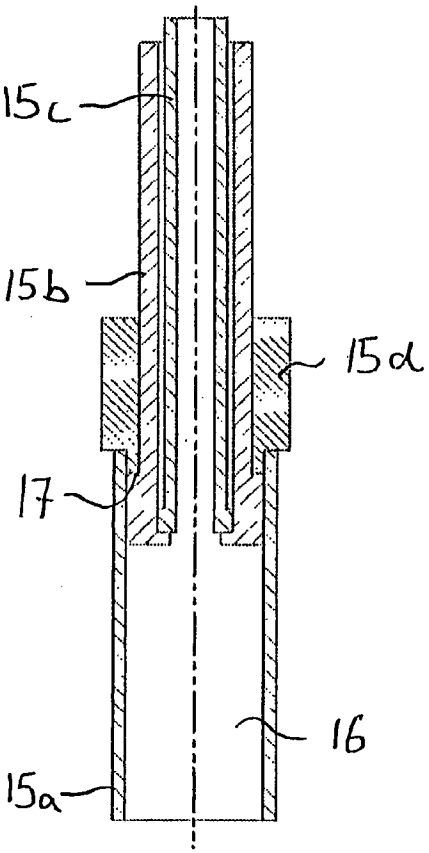
Figure 5:
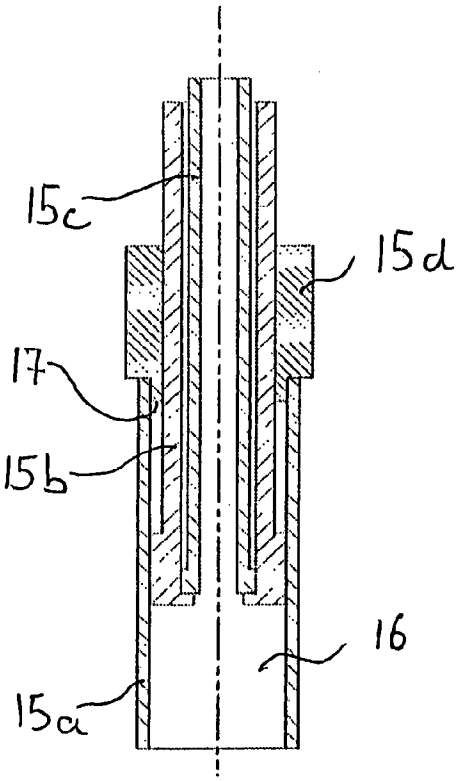

FIGS. 5, 6, and 7 show the lifting cylinder 15 in different positions. It is possible to see in each case the cylinder tube 15*a*, the first piston 15*b*, and the second piston 15*c*. Identical lifting cylinders 15 are arranged on each side of the lifting framework, that is to say in the region of the left-hand column and of the right-hand column.

FIG. 5 illustrates the lifting cylinder 15 in a position which corresponds to a position of the lifting framework between the position in FIG. 2 and the position in FIG. 3. The first piston 15*b* here is raised by the pressure prevailing in the pressure chamber 16 of the lifting cylinder 15. On account of its relatively small piston surface area, however, the pressure which is present in the pressure chamber 16 is not sufficient in order to raise the second piston 15*c* relative to the first piston 15*b*.

In that position of the lifting cylinder shown in FIG. 6 corresponding to the position of the lifting framework according to FIG. 3, the first piston 15*b* has reached a stop 17 on the cylinder head 15*d*, which is connected rigidly to the cylinder tube 15*a*. This stop 17 precisely defines the maximum extendible length of the first piston 15*b* and, thus, the top end position of the first extendible mast 11. Since identical lifting cylinders 15 are arranged in each of the two columns of the lifting framework, it is ensured that, at least when stop 17 has been reached, the extendible lengths of the first pistons 15*b* on each side of the lifting framework are equal and the first extendible mast 11 is thus braced parallel to the vertical mast 10.

FIG. 7 shows the lifting cylinder once the extending movement of the second piston 15*c* and, thus, of the second extendible mast 12 has begun. The pressure in the pressure chamber 16 has further increased in comparison with the state according to FIG. 6, and thus presses the first piston 15*b* against the stop 17 and, at the same time, causes the second piston 15*c* to extend.

Figure 8:
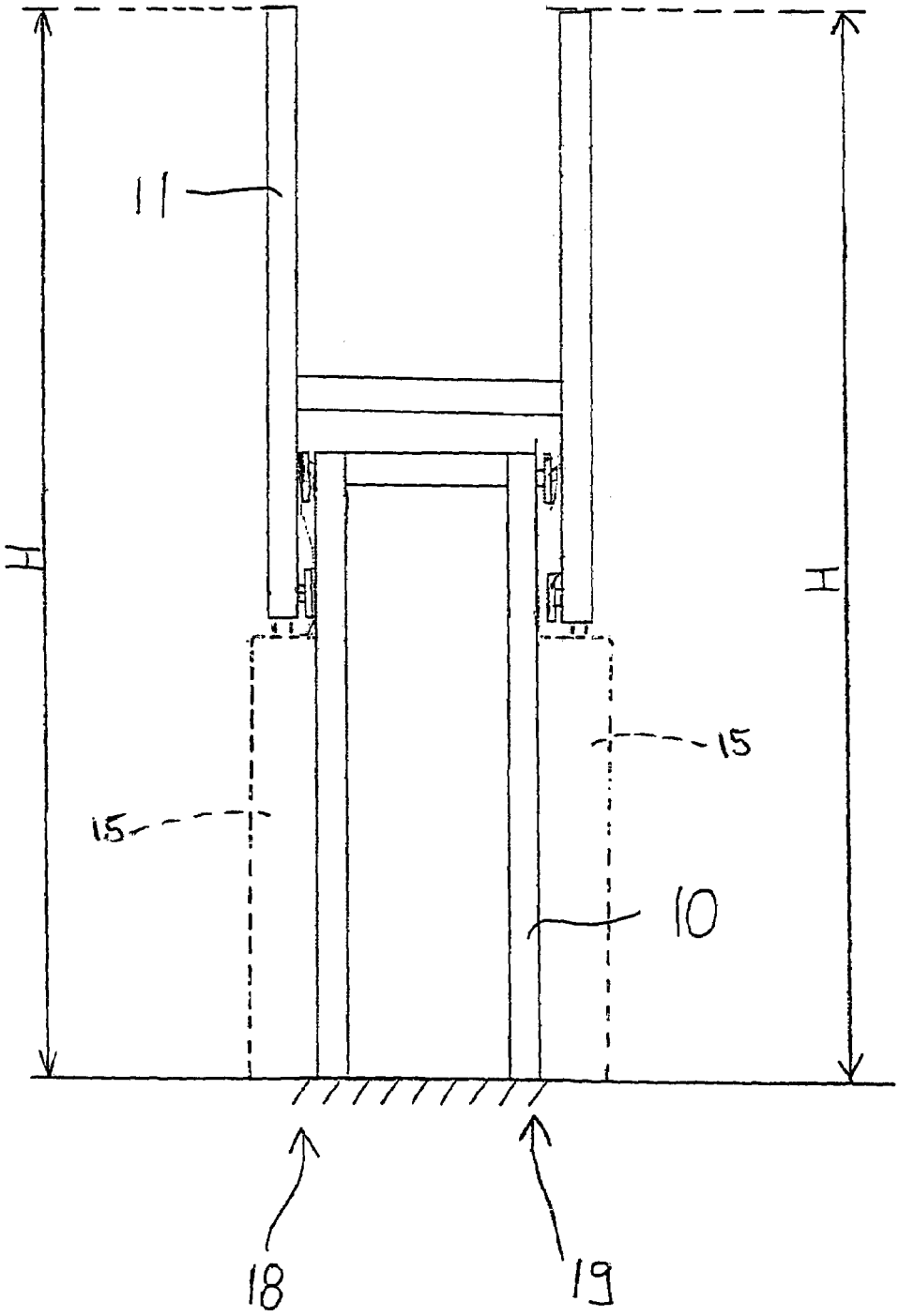
FIG. 8 shows a front view of a lifting framework according to the invention.

In FIG. 8, the vertical mast 10 and the first extendible mast 11 of the lifting framework according to the invention are illustrated in a view corresponding to FIG. 1. The configuration according to the invention of the lifting cylinder 15 (not shown in this illustration) with the stop 17 ensures that the first extendible mast 11 has the same maximum extendible height H in the region of each of the columns 18, 19 of the lifting framework. This, at the same time, ensures that a lateral inclination of the first extendible mast 11 is prevented since, for this purpose, the first piston 15*b* of one of the two lifting cylinders 15 would have to detach itself from the stop 17 counter to the increased hydraulic pressure in the pressure chamber 16 (see FIG. 7).

As an alternative to the stops 17 which are integrated in the lifting cylinders 15, it is also possible for stops which define the maximum extendible height H of the first extendible mast 11 to be provided on the outside of the lifting framework. In the case of this solution, in each case, one stop for the extendible mast 11 has to be provided in the region of each of the columns 18, 19 on the vertical mast 10. The bracing of the extendible mast 11 on the stops of the vertical mast 10 then takes place by means of the hydraulic pressure in the lifting cylinder 15, this pressure significantly increasing at the end of the extending movement of the first extendible mast 11, before the extending movement of the second extendible mast 12 (see FIGS. 6 and 7) begins.

Figure 10:
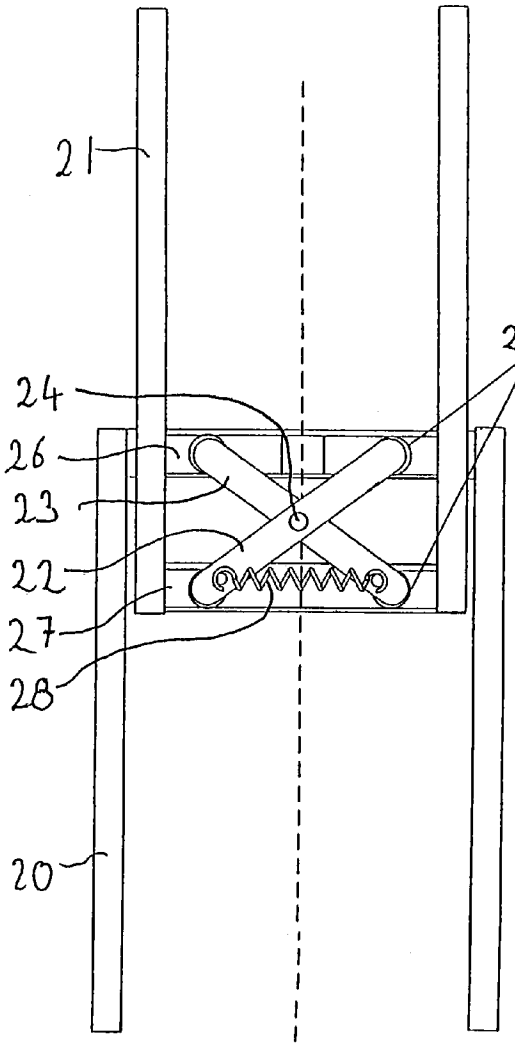
FIGS. 9 and 10 show a scissor mechanism.
Figure 9:
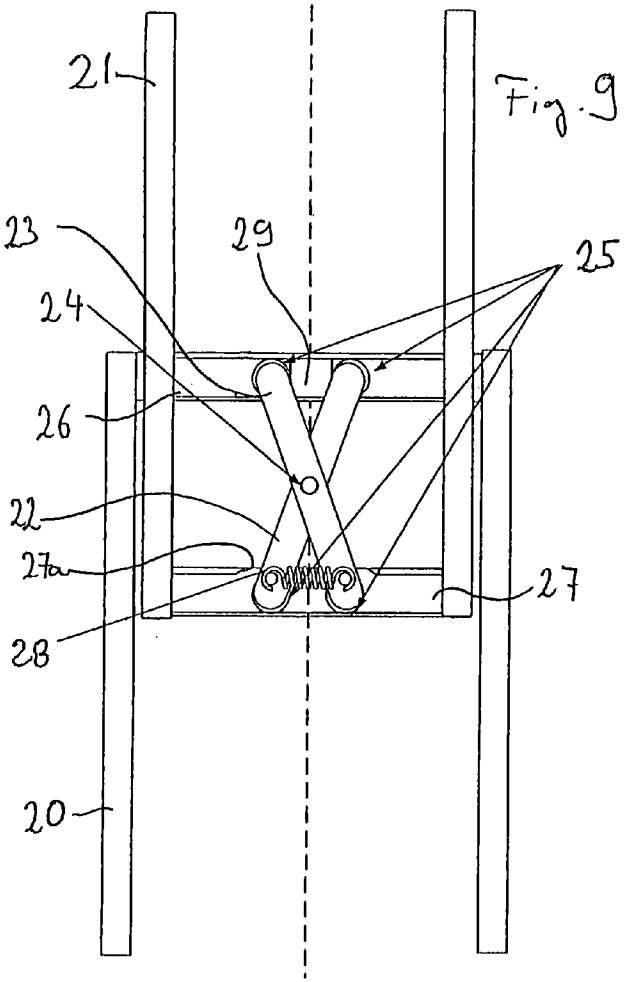

An alternative solution for bracing an extendible mast 21 with a vertical mast 20 is illustrated in FIGS. 9 and 10. The means for bracing the extendible mast 21 with the vertical mast 20 is formed, in this case, by a scissor mechanism and takes effect just before the top end position of the extendible mast 21 is reached. The scissor mechanism comprises two symmetrical levers 22, 23 which are connected to one another by means of a joint 24. The ends of the levers 22, 23 are guided by means of guide rollers 25 in a guide rail 26 arranged on the vertical mast 20 and, in the region of the top end position of the extendible mast 21, in a guide rail 27 arranged on the extendible mast 21. In order to allow the extendible mast 21 to move downwardly, starting from the position illustrated in FIG. 9, the guide rail 27 has a cut-out 27*a* on the top side. The rest position of the scissor mechanism, which is illustrated in FIG. 9, is defined by the tension spring 28 and the stop 29 for the top guide rollers 25.

Functioning is as follows: when the extendible mast 21, starting from the position illustrated in FIG. 9, is moved further upwardly, the ends of the levers 22, 23 are forced outwardly, in which case the guide rollers 25 move outwardly in the guide rails 26, 27. On account of the leg lengths of the levers 22, 23 being equal, this is only possible when the two guide rails 26, 27 are parallel to one another. If this was not previously the case, the scissor mechanism renders the guide rails 26 and 27 parallel when the top end position of the extendible mast 21, which is illustrated in FIG. 10, has been reached, and this, at the same time, results in the vertical mast 20 and extendible mast 21 being oriented parallel to one another.

It will be readily appreciated by those skilled in the art that modifications may be made to the invention without departing from the concepts disclosed in the foregoing description. Accordingly, the particular embodiments described in detail herein are illustrative only and are not limiting to the scope of the invention, which is to be given the full breadth of the appended claims and any and all equivalents thereof.

What is claimed is:

1. A lifting framework for an industrial truck, comprising:

a guide mast;

at least one extendible mast, the extendible mast being guided on the guide mast by rollers such that the extendible mast is movable in a vertical direction between a bottom end position and a top end position; and means for bracing the extendible mast with the guide mast, this bracing means taking effect, at least when the extendible mast is located in the top end position, so as to prevent the extendible mast from inclining in a lateral direction of the lifting framework relative to the guide mast, wherein the lifting framework includes a vertical mast, a first extendible mast guided on the vertical mast, and a second extendible mast guided on the first extendible mast, wherein the framework includes a lifting-drive device configured such that, in a first instance, the first extendible mast, together with the second extendible mast, is raised relative to the vertical mast and, thereafter, the second extendible mast is raised relative to the first extendible mast, wherein the lifting-drive device includes a hydraulic telescopic cylinder located at each side of the lifting framework, the telescopic cylinders comprising a cylinder tube, a first piston moveable in the cylinder tube, and a second piston moveable in the first piston, wherein the first piston of the telescopic cylinder directly raises the first extendible mast relative to the vertical mast, and the second piston of the telescopic cylinder directly raises the second extendible mast relative to the first extendible mast, wherein the cylinder tube of the telescopic cylinder is connected to the vertical mast, the first piston of the telescopic cylinder is connected to the first extendible mast, and the second piston of the telescopic cylinder is connected to the second extendible mast, and wherein a stop is located in each cylinder tube and is configured to engage the first piston, and wherein pressure in the cylinder tube pushes on a bottom surface of the first piston to move the first piston until the first piston engages the stop, at which time fluid pressure on a bottom surface of the second piston moves the second piston in the first piston.

2. The lifting framework according to claim 1, including two columns which are spaced apart in the lateral direction of the lifting framework.

3. The lifting framework according to claim 1, including means for bracing the first extendible mast with the vertical mast and a means for bracing the second extendible mast with the first extendible mast.

4. The lifting framework according to claim 1, including a means for bracing the first extendible mast with the vertical mast is provided.

5. A lifting framework for an industrial truck, comprising:

a guide mast;

at least one extendible mast, the extendible mast being guided on the guide mast by rollers such that the extendible mast is movable in a vertical direction between a bottom end position and a top end position; and means for bracing the extendible mast with the guide mast, this bracing means taking effect, at least when the extendible mast is located in the top end position, so as to prevent the extendible mast from inclining in a lateral direction of the lifting framework relative to the guide mast, wherein the guide mast comprises a vertical mast, wherein a first extendible mast is guided on the vertical mast, and wherein the framework includes means for bracing the first extendible mast with the vertical mast, wherein the guide mast and the at least one extendible mast have two columns which are spaced apart in the lateral direction of the lifting framework, wherein the means for bracing the extendible mast with the guide mast is configured such that, when the extendible mast is located at or near the top end position, a vertical movement of the extendible mast relative to the guide mast is prevented, and wherein, when the extendible mast is located at or near the top end position, the two columns of the extendible mast are coupled to one another by a scissor mechanism.

* * * * *